United States Patent [19]

Dalke

[11] 4,417,562

[45] Nov. 29, 1983

[54] CARBURETOR MIXTURE CONTROL APPARATUS

[76] Inventor: Arthur E. Dalke, 11814 E. 36th St., Tulsa, Okla. 74145

[21] Appl. No.: 271,701

[22] Filed: Jun. 8, 1981

[51] Int. Cl.[3] ..... F02M 29/02; F02B 31/00

[52] U.S. Cl. ..... 123/592; 123/306; 261/79 R; 48/180 S

[58] Field of Search ..... 123/590, 591, 592, 306; 261/79 R, DIG. 39; 48/180 R, 180 C, 180 M, 180 S

[56] References Cited

U.S. PATENT DOCUMENTS

| | | | |
|---|---|---|---|
| 1,241,135 | 9/1917 | Mastenbrook | 261/79 R |
| 1,857,070 | 5/1932 | Thomas | 261/79 R |
| 3,395,899 | 8/1968 | Kopa | 261/79 R |

FOREIGN PATENT DOCUMENTS

| | | | |
|---|---|---|---|
| 176437 | 6/1935 | Fed. Rep. of Germany | 123/590 |

*Primary Examiner*—William A. Cuchlinski, Jr.
*Assistant Examiner*—E. Rollins Cross
*Attorney, Agent, or Firm*—Head, Johnson & Stevenson

[57] ABSTRACT

A mixture control device for automatically controlling the air to fuel mixture of a conventional carburetor involving a plurality of sloped radial vanes circumferentially located within the annulus formed by the booster venturi and the venturi tube. By inducing significant centrifugal motion in the air passing outside the booster venturi the problems associated with fuel to air mixture changes associated with changes in elevation and changes in seasonal temperatures are alleviated.

2 Claims, 4 Drawing Figures

CARBURETOR MIXTURE CONTROL APPARATUS

BACKGROUND OF THE INVENTION

1. Field of the Invention

This invention relates to an automatic mixture control device for a carburetor. More specifically, it relates to a device that compensates for naturally occurring rich/lean variations associated with changes in elevation, temperature and humidity.

2. Description of the Prior Art

Various devices and apparatus to swirl the air and fuel mixture as it enters the combustion chamber of an internal combustion engine have been proposed and employed for various purposes. Such devices have involved both stationary as well as rotating members at various physical locations in order to solve specific problems. For example, U.S. Pat. Nos. 3,077,391, 3,938,967 and 4,092,966 have suggested the use of stationary blades or vanes between the carburetor and intake manifold with the intent of creating a high degree of turbulence for atomizing and more completely vaporizing the fuel for improved performance. U.S. Pat. No. 3,437,467 additionally suggests the introduction of air within a helical swirl vane structure located between the carburetor and the intake manifold for the same atomizing purpose, while U.S. Pat. No. 3,544,290 employs a strainer followed by a sonic vibrator which could either be a stationary member or a rotating propeller.

Various other patents have suggested other rotating or rotatable members between the carburetor and intake manifold including a sieve followed by a flow driven spinning bowl of U.S. Pat. No. 3,946,717 and a droplet collector followed by a set of rotatable impellers of U.S. Pat. No. 3,955,548. In U.S. Pat. No. 4,080,943 a pair of counterrotating paddles are employed while in U.S. Pat. No. 4,116,187 a paddle wheel type blender and charger apparatus is disclosed and in U.S. Pat. No. 4,153,028 a cylindrical rotator with openings is used.

Other physical locations for such devices have been suggested such as stationary vanes near each intake valve internal to the combustion chamber as in U.S. Pat. No. 1,969,202 and similar vanes on the intake manifold side near the valves as in U.S. Pat. No. 4,151,816. In U.S. Pat. Nos. 2,027,480 and 2,051,556 a rotating device at the base of the intake manifold is disclosed to distribute liquid droplets particularly during periods of acceleration. In fact, rotatable membes have been employed as essentially the exclusive means for vaporizing fuel such as in some very early rotating fan carburetors of U.S. Pat. Nos. 1,106,452 and 1,150,115 and later in U.S. Pat. No. 2,665,892.

More recently, for example in U.S. Pat. No. 4,130,099, a gas saving device between the carburetor and intake manifold involving a spiral grooved venturi to provide spin within the manifold is employed and in U.S. Pat. No. 3,395,899 a fuel injection system with a cyclonic flow inducing member is combined with a conventional booster venturi system to reduce emissions and improve operating characteristics.

However, essentially all of the above devices ignore a fundamental problem associated with the contemporary gasoline carburetor employing a booster venturi system. Thus, none of the above references alleviate the inherent fuel to air mixture enriching which occurs with increased elevation and fuel to air mixture leaning associated with a decrease in the ambient temperature and similar effects associated with humidity variations. Consequently, it is still a common practice to retune and adjust the carburetor when traveling in mountainous areas or during seasonal changes.

SUMMARY OF THE INVENTION

In view of the problems associated with the tendency of the air to fuel mixture of a conventional booster venturi type carburetor to change with changes in elevation or seasonal temperatures, I have discovered an improved carburetor of reduced sensitivity to such changes comprising:

(a) at least one venturi tube;

(b) at booster venturi located within the venturi tube; and (a) a means associated with the booster venturi to produce centrifugal motion in the air passing between the outside of the booster venturi and the inside of the venturi tube.

The present invention provides that the means to produce centrifugal motion is a plurality of sloped radial vanes circumferentially located within the annulus formed by the booster venturi and the venturi tube. The invention further provides that the plurality of radial vanes be either attached to the booster venturi or the venturi tube or be attached to each other and adapted to rest between the booster venturi and the venturi tube. It is also provided that the radial vanes be sloped at about a 45° angle to the direction of the air flow and that a small hole be drilled in the tube delivering fuel to the booster venturi.

It is an object of the present invention to provide a carburetor of reduced sensitivity to changes in elevation, seasonal temperature changes and the like. It is an additional object that an inexpensive and easily installed device to accomplish the previous object be provided that is compatible with the conventional booster venturi type carburetor. Fulfillment of these objects and the presence and fulfillment of other objects will be readily apparent upon complete reading of the specification and claims taken in conjunction with the attached drawing.

DESCRIPTION OF THE PREFERRED EMBODIMENTS

The automatic mixture control device of the present invention, how it relates to the conventional booster venturi type carburetor and how it operates can perhaps be best explained and understood by reference to the accompanying drawing.

Figure 4:
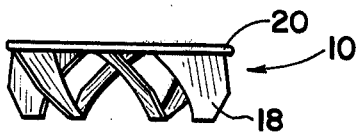
FIG. 4 is a side view of the mixture control apparatus.
Figure 3:
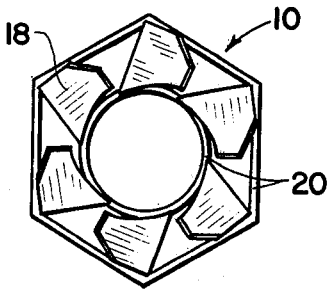
FIG. 3 is a bottom view of the mixture control apparatus.
Figure 2:
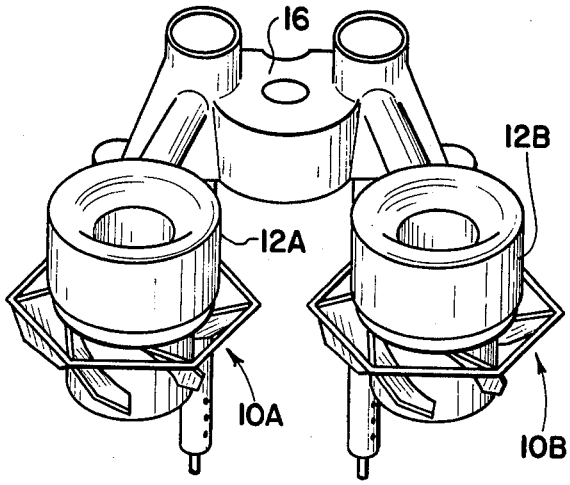
FIG. 2 is a perspective view of a nozzle bar and booster venturi assembly with a mixture control apparatus of the present invention installed on each booster venturi.
Figure 1:
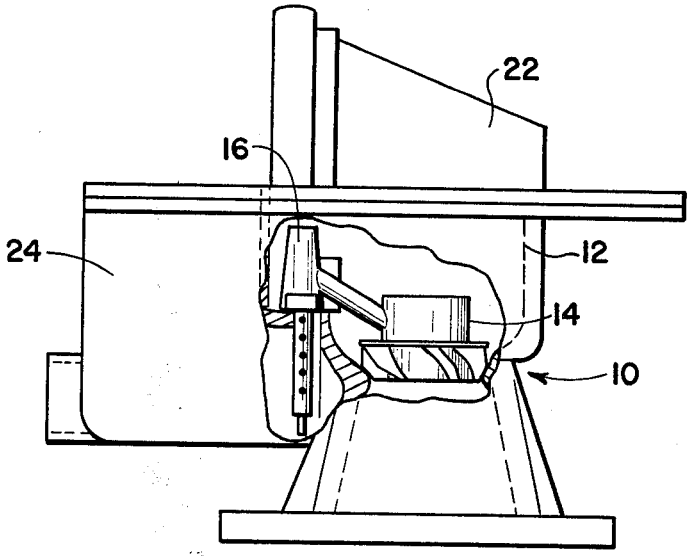
FIG. 1 is a simplified partial cut-away side view of a conventional carburetor with the mixture control apparatus of the present invention installed.

FIG. 1 is a simplified cross-sectional side view of a conventional carburetor with the present fuel to air mixture control device, generally designated by the numeral 10, installed in the annulus formed by the inside of the large venturi tube or throat 12 and the booster venturi 14. As illustrated in FIG. 2 the mixture control device 10 is actually a pair of identical devices 10A and 10B each circumferentially mounted to the outside perimeter of each booster venturi 14A and 14B of the nozzle bar and booster venturi assembly 16. The fuel to air mixture control device 10, as illustrated in FIGS. 3 and 4, is a plurality of vanes 18 (six in this embodiment) mounted equidistant from each other in a wire cage 20 sized such as to slip over the booster venturi 14 and then insert within the large venturi tube 16. Each vane 18 is held in a radial position relative to the circular cross-section of the booster venturi 14 and sloped at about a 45° angle relative to the direction of the flow of the air. In operation, air enters the carburetor of FIG. 1 through the air horn 22 traveling downward through the large venturi tube 12 past the booster venturi 14 and mixture control device 10 and then enters the intake manifold (not shown) below the carburetor. As the air passes through the booster venturi 14 located in the restriction of the venturi tube 12 a velocity induced pressure gradient perpendicular to the direction of the air flow will withdraw fuel from the float bowl 24 through the nozzle bar and booster venturi assembly 16 and mix it with the air. The air passing on the outside of the booster venturi 14 is swirled by the vanes 18 as it passes through the mixture control device 10. This swirling or centrifugal motion at the point where the pressure gradient to withdraw fuel takes place (i.e., at the booster venturi) is viewed as being critical to the present invention and a distinguishing feature. It has been found that the presence of significant centrifugal motion or more specifically angular velocity at the booster venturi will make the fuel to air mixture ratio a function of density (i.e., dependent on mass flow as opposed to volume flow) in a manner than compensates for naturally occurring enriching and leaning effects associated with changes in elevation and seasonal temperature changes.

In other words, it is known that as the density of the air decreases (i.e., as the air becomes lighter, such as driving in the mountains) the fuel to air mixture of the conventional carburetor becomes richer. Just the opposite occurs when the temperature drops such as during winter and consequently the fuel to air mixture leans out. In contrast, by placing vanes in the venturi to spin the air as it passes through, centrifugal force becomes significant. As the air becomes lighter (due to temperature, humidity or altitude) the centrifugal force decreases for the same rate of air flow. This causes the low pressure area in the center or restriction of the venturi to vary as the weight of the air varies. The booster venturi, where fuel is added to the air, is located in this low pressure area. Thus the air drawn through the booster venturi also varies with the weight of the air and the fuel drawn into the air varies as the weight of the air varies. This maintains a correct fuel to air ratio since the ratio should be by weight and not by volume.

In implementing the present invention in a conventional carburetor, it has been found that several small air bleed holes can advantageously be drilled in the tube carrying metered fuel to the booster venturi to arrive at the desired mixture ratio. Preferably a series of up to three or four 0.04 inch air bleed holes are usually sufficient when employing a six vaned 45° angle mixture control device as illustrated in the drawing. To install such a device the air horn and nozzle bar and booster venturi assembly or their equivalent is disassembled. The mixture device is then either slipped onto the booster venturi or merely placed in the large venturi tube and the carburetor is reassembled.

The device itself can be fabricated out of any conventional metal or its equivalent. Preferably the mixture control device is a separate replacable unit but the vanes could alternatively be molded directly into the booster venturi or the large venturi side walls.

Thus, the present invention represents an inexpensive and easily installed automatic mixture control device with no mechanical moving parts. It controls the mixture by using the weight of the air, which varies as the density varies, allowing leaner mixtures to be burned in the engine. This helps to reduce pollution and give better gas mileage. It also reduces the frequency of seasonal carburetor adjustments while allowing greater operational range free of adjustment.

Having thus described the invention with a certain degree of particularity, it is manifest that many changes can be made in the details of construction and arrangement of components without departing from the spirit and scope of this disclosure. Therefore, it is to be understood that the invention is not limited to the embodiment set forth herein for purposes of exemplification, but is to be limited only by the scope of the attached claims, including a full range of equivalents to which each element thereof is entitled.

I claim:

1. A carburetor comprising:

(a) at least one venturi tube;

(b) a booster venturi located within said venturi tube; and (c) a vane means associated with said booster venturi to produce centrifugal motion in the air passing between the outside of said booster venturi and the inside of the venturi tube, wherein said vane means is a plurality of radial vanes sloped at about 45° angle to the direction of the air flow and located within the annulus formed by said booster venturi and said venturi tube.

2. A carburetor of claim 1 wherein a hole is drilled in the tube delivering fuel to said booster venturi.

* * * * *